US006288979B1

(12) United States Patent
Kwok

(10) Patent No.: US 6,288,979 B1
(45) Date of Patent: Sep. 11, 2001

(54) SOLAR-DRIVEN ETERNITY CLOCK

(75) Inventor: Joseph Tak Ming Kwok, Tai Po (HK)

(73) Assignee: Moneray International Ltd., Kowloon (HK)

( * ) Notice: Subject to any disclaimer, the term of this patent is extended or adjusted under 35 U.S.C. 154(b) by 0 days.

(21) Appl. No.: 09/544,720

(22) Filed: Apr. 6, 2000

(51) Int. Cl.[7] ..... G04B 1/00; G04C 3/00
(52) U.S. Cl. ..... 368/205
(58) Field of Search ..... 368/203–205

(56) References Cited

U.S. PATENT DOCUMENTS

Re. 35,043 9/1995 Takeda .
4,015,420 * 4/1977 Walker .
4,634,953 1/1987 Shoji et al. .
4,763,310 8/1988 Goetzberger .

* cited by examiner

*Primary Examiner*—Vit Miska
(74) *Attorney, Agent, or Firm*—Donald N. MacIntosh; Flehr Hohbach Test Albritton & Herbert LLP

(57) ABSTRACT

An electronic eternity clock is powered by solar cells. The LCD segment display is shut down during the night by the use of a sensing circuit utilizing sampling pulses from an associated microcontroller which turns a transistor on and off which is connected to a floating ground between the solar cell and an isolating diode, both series connected across the rechargeable battery.

3 Claims, 1 Drawing Sheet

SOLAR-DRIVEN ETERNITY CLOCK

BACKGROUND OF THE INVENTION

Electronic clocks with a liquid crystal display (LCD) commonly made up of segments include a quartz crystal oscillator for providing timing pulses and are powered both by solar power and rechargeable battery. These are known as shown by Goetzberger U.S. Pat. No. 4,763,310. Since the battery power is limited, it is desirable to minimize power consumption of the battery by turning off the LCD display when it is not visually observable.

The above patent discloses how to do this by providing a diode connected between a solar cell array and the battery which permits the battery to be recharged by the solar cell array, but prevents the display from drawing energy from the battery. Thus, in effect, the liquid crystal display is only in operation when there is enough light for reading the display. However, the battery still provides power to the internal clock circuit. Thus, energy is saved which is used to power the clock electronics for a longer period of time and results in a substantial increase in battery power reserve.

One difficulty with the foregoing is that since the solar cell array is a current source, the voltage at its terminals, up to its rated terminal voltage, will invariably depend on the electrical load it is driving. In an electronic clock of the present type where LCD segments are being switched to provide different numbers, this causes the load to change and thus a varying voltage will appear between the liquid crystal segments causing display malfunctions or undesirable display effects such as ghost shadows or a dim display. Also, normally, the liquid crystal display requires an alternating voltage to drive its segments and thus requires elaborate circuitry to provide the proper type of voltage. Finally, there is a very delicate balance between capacity of the solar cell to trickle charge the rechargeable battery and the amount of energy needed to be provided by that battery to insure continued and reliable operation of the timing circuitry during nighttime operation.

OBJECT AND SUMMARY OF THE INVENTION

It is a general object of the present invention to provide an improved solar driven eternity clock.

In accordance with the above object, the electronic clock comprises a rechargeable battery having common and positive terminals. Liquid crystal display means having segments indicate the time of the clock. Microcontroller means are responsive to the timing pulses and include means for driving the segments and means for generating sampling pulses. A solar cell and a diode series are connected across the terminals for charging the battery and powering the microcontroller means during conditions of a greater than minimum predetermined level of ambient light impinging on the solar cell. Voltage level sensing means sense a voltage level at a point between the diode and solar cell are responsive to the sampling pulses from the microcontroller means for turning off the segment driving means if said voltage level is below a predetermined threshold.

DETAILED DESCRIPTION OF THE PREFERRED EMBODIMENT

Figure 1:
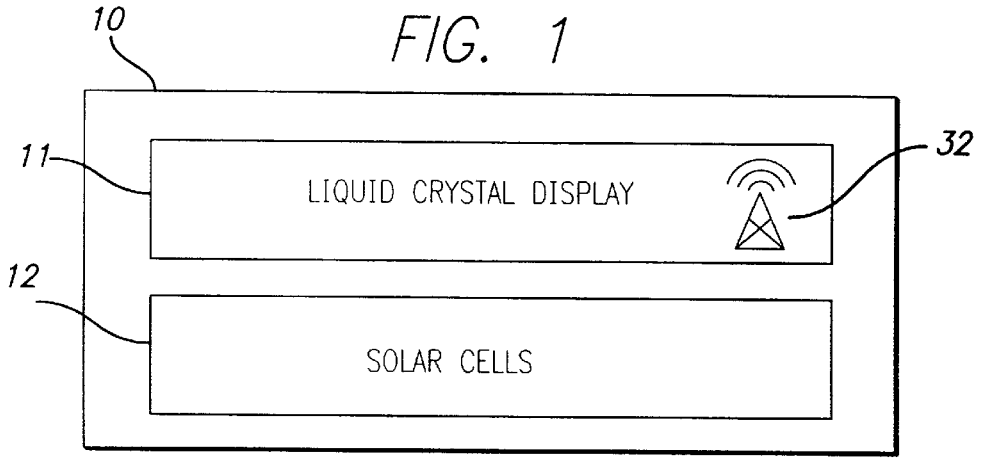
FIG. 1 is a plan view of an electronic clock embodying the present invention.

FIG. 1 shows the faceplate of the electronic clock 10 of the present invention having a liquid crystal display 11 (which displays numbers for clock time and also letters for dates). In addition there is a solar cell array 12 which, for example, might include four commercial solar cells arranged series. Such solar cells can deliver approximately 3 uA per square inch of solar cell area under a light intensity of 300 Lux.

Figure 2:
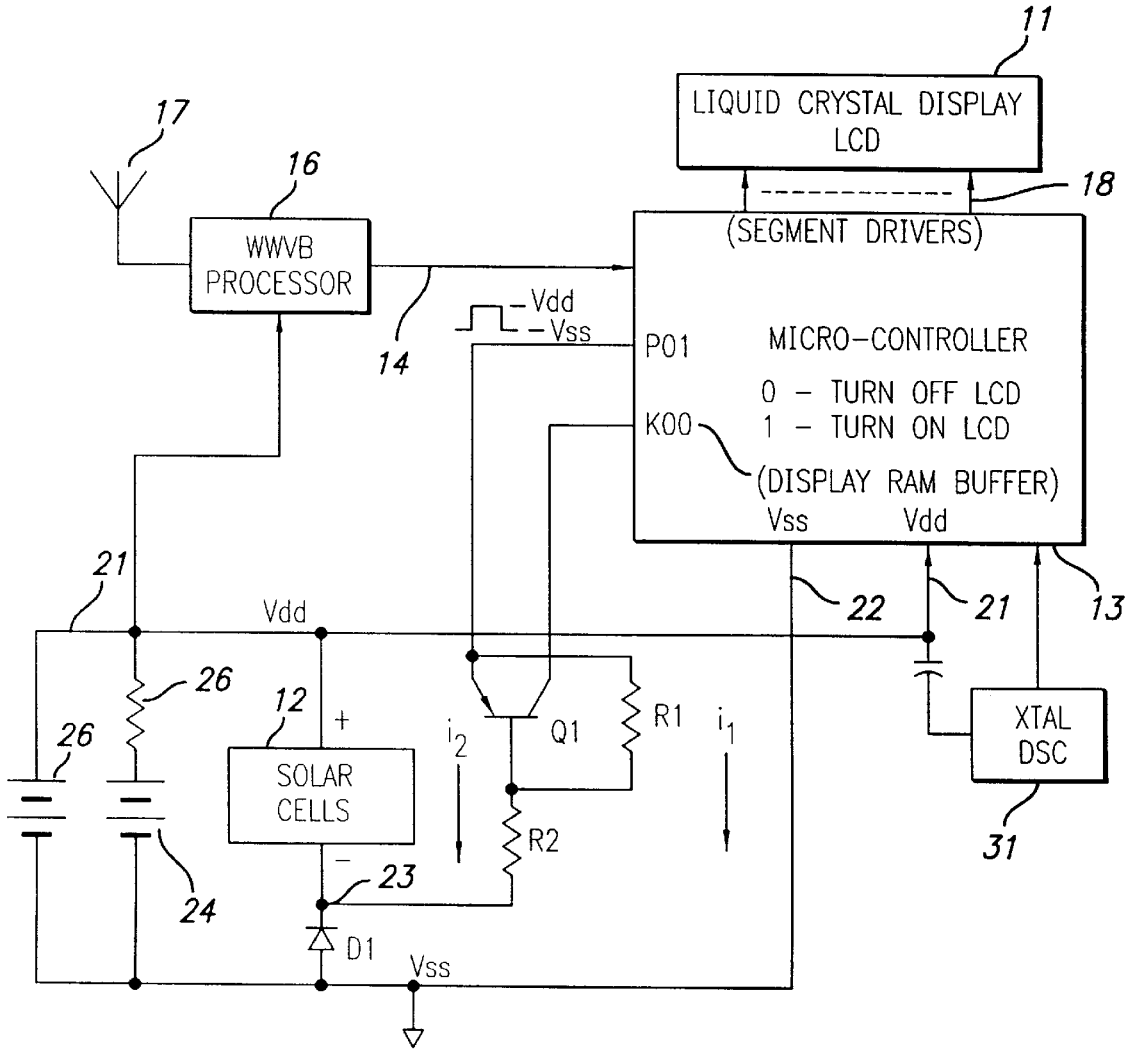
FIG. 2 is a schematic circuit diagram of the electronic clock.

FIG. 2 is the circuit block diagram for the electronic clock which has as its key component a microcontroller 13 which is commercially available and slightly modified to meet the demands of the present invention. Specifically the microcontroller 13 receives a radio timing signal on line 14 from a WWVB processor 16 having an antenna 17. This is a radio station which puts out a coded timing signal which maintains the accuracy of a digital clock and also accommodates leap years, Daylight Savings Time and leap seconds. This is all well-known.

Microcontroller 13 drives the segments of the liquid crystal display through a plurality of segment drivers 18. It has as an output from a terminal PO1 a sampling pulse which at its upper level approaches a power supply voltage Vdd and at its lower level Vss, common or ground. Vdd on line 21 powers the microcontroller 13, crystal oscillator 31, processor 16 and associated liquid crystal display segments 11. Vss on line 22 is essentially common or ground for the circuit.

Solar cells 12 are connected in series with diode D1 between Vdd and Vss. A connection point 23 between the series connected solar cell 12 and diode D1 is designated FG for floating ground. This point is a voltage level which is proportional to the level of the impinging ambient light on the solar cell. In other words, it indicates whether the solar cell is receiving enough light to both drive the microcontroller 13 through the Vdd line and also to recharge a parallel connected rechargeable battery 26 which is connected between Vdd and Vss. The additional battery 24 (normally not installed) is provided in case of emergency, to recharge the internal storage battery 26 in case it is depleted during long period of unuse.

With the parallel connection shown, the voltage across the circuit will effectively be held constant by the battery 26. This prevents the undesirable LCD segment side effects mentioned above. The FG point 23, is connected through a resistor R2 to the base of a transistor Q1 having a second by-pass resistor R1 between the emitter and base. The emitter is connected to the sampling pulse output PO1 of the microcontroller. The collector of the transistor is connected to a K00 input of microcontroller 13 which controls a display RAM buffer connected to the segment drivers 18. When an effective 0 is applied to K00, this turns off the liquid display LCD; an effective 1 turns on the LCD display. Thus, the monitoring of the light irradiation intensity onto the solar cell is measured. The negative terminal of the solar cell is made to float by adding the isolation diode D1 so that the voltage potential at FG relative to Vdd will be directly related to the current it can supply to the circuit, thus transistor Q1 and associated circuitry serve as voltage level sensing means. Moreover, since this circuitry is not directly connected to Vdd, during LCD off no current can be drained from the batteries since the sensing circuitry can only take current (if available) from the solar cell. This further achieves the purpose of saving energy for the storage battery.

In operation, sampling pulses are presented to the emitter terminal of transistor Q1 so that when the solar cell is supplying sufficient current, there is current flowing through the base-emitter junction of the transistor. The transistor is turned on resulting in a logic 1 (that is a voltage close to Vdd) at the collector terminal of the transistor, and thus the K00 input to microcontroller 13. When there is not enough current flowing through the solar cell, the transistor Q1 will not turn on and so logic 0 (a voltage close to Vss) will appear at the collector terminal of the transistor Q1 which signals the K00 input to turn off the LCD. And the turn on and turn off, of course, is determined by the current $i_1$ times the resistor R1, the current $i_1$ being essentially equal to $i_2$, being less or more than the base emitter turn on voltage.

Completing the circuit of FIG. 2 the crystal oscillator 31 supplies necessary timing pulses to microcontroller 13 and is also powered by Vdd.

Now discussing how the various power balance levels and consumption levels in the circuit, the overall circuit consumes about 40 uA is discussed above for the LCD display and less than 12 uA for the other circuits including microcontroller unit 13 and its peripheral circuit that drives the liquid crystal display. Under such conditions, the solar cell when it is being illuminated that made it by sufficient light supplies 120 uA to the circuit which takes up to 52 uA. The remaining 68 uA is used to trickle charge the rechargeable battery 24. However, with present-day circuits, the 68 uA rechargeable battery may not have enough capacity to replenish the energy loss required to sustain unit operation (that is the timing function) at nightime. To overcome this, the microcontroller unit constantly senses the voltage level which is directly proportional to the ambient brightness of the solar cell power source. Under insufficient brightness the LCD crystal panel is not useful as a visual display. This is therefore turned off if the solar cell voltage level, FG, is below the predetermined threshold as discussed above. When this is achieved, the energy saved by de-energizing the display RAM buffer and the segment driver is a saving of 40 uA. Thus, this effectively enhances the life of the clock without recharging or battery change. In other words, under such an arrangement, the clock/calendar can run almost perpetually without worrying about battery changing or loss of time to recharge or depleted batteries. The back-up battery 24 is added as a precaution.

Finally, on the liquid crystal display 31, is a wavemark 32 (transmission tower with three semi-circles over point of tower) display. This is used to inform about the status of reception of WWVB radio signals broadcasted by the NIST (National Institute of Standards and Technology) The display of the signal serves two purposes. First, when the display of time is synchronized with the received time three waves are displayed as shown in FIG. 1. Secondly, for testing purposes during each second, the microcontroller detects the received pulse, such that if the incoming pulse is considered to be a 200 ms pulse, a single wave will be displayed. If the incoming pulse is considered to be a 500 ms pulse then the single wave is first displayed for the first 200 ms approximately and then a double wave will be displayed for up to 500 ms. If the incoming pulse is considered to be a 800 ms pulse, then firstly the single wave will be displayed for the first 200 ms approximately, then the double wave will be displayed up to 500 ms and then the full three waves will be displayed up to 800 ms. In so doing, the wavemark gives an indication as to what type of signal the circuit has just received thus facilitating the test and inspection. Also, this gives an animated picture to the user about the different strength of the incoming radio wave due to its varying modulation duration.

Thus an effective eternity clock has been provided.

What is claimed is:

1. An electronic clock comprising:

a rechargeable battery having common and positive terminals;

liquid crystal display means having segments for indicating the time for said clock;

microcontroller means connected to and powered from said positive terminal responsive to timing pulses including means for driving said segments and including means for generating sampling pulses;

a solar cell and a diode series connected therewith across said terminals for charging said battery and powering said microcontroller means during conditions greater than a minimum predetermined level of ambient light impinging on said solar cell;

voltage level sensing means for sensing a voltage level at a point between said diode and solar cell and responsive to said sampling pulses from said microcontroller means for turning off said segment driving means if said voltage level is below a predetermined threshold.

2. An electronic clock as in claim 1 where said voltage level sensing means includes a transistor having an emitter, collector and base terminals with the emitter being connected to receive said sampling pulses, said base being connected to said voltage level sensing point between said diode and solar cell and with said collector connected to said microcontroller for disabling and enabling said segment driving means.

3. An electronic clock as in claim 1 where said voltage level is proportional to said level of impinging ambient light on said solar cell.

* * * * *